United States Patent [19]

Olschewski

[11] Patent Number: 4,822,031

[45] Date of Patent: Apr. 18, 1989

[54] POOL EXERCISE DEVICE

[76] Inventor: Horst A. Olschewski, 10011 Sandpiper Rd., East, Bradenton, Fla. 34209

[21] Appl. No.: 120,141

[22] Filed: Nov. 13, 1987

[51] Int. Cl.[4] ..... A63B 1/00; B25G 3/28

[52] U.S. Cl. ..... 272/71; 272/62; 403/354; 403/375

[58] Field of Search ..... 272/62, 63, 71, 93, 272/900, 102, 103, 1 B, DIG. 4, 1 R; 403/292, 375, 381, 354; 434/254

[56] References Cited

U.S. PATENT DOCUMENTS 2,954,977 10/1960 Durlacher ..... 272/63

3,929,330 12/1975 Cerasoli ..... 272/63

4,657,242 4/1987 Guridi ..... 272/62

4,772,011 9/1988 Guridi ..... 272/900

*Primary Examiner*—Richard J. Apley

*Assistant Examiner*—S. R. Crow

*Attorney, Agent, or Firm*—Gifford, Groh, Sheridan, Sprinkle and Dolgorukov

[57] ABSTRACT

A pool exercise device includes a pair of supports having upright portions having a slot therein. End members having a regular angular geometric shape are removably positioned in the slots. Rods fixed to the end members project colinearly and are connected by a sleeve. The height of the rods is adjusted by removing the end members from the slots, selectively rotating, and returning the end members to the slots for securement therein.

4 Claims, 1 Drawing Sheet

POOL EXERCISE DEVICE

BACKGROUND OF THE INVENTION

1. Field

The present invention relates to physical development equipment and, more particularly, to exercise apparatus for use by a person in a swimming pool or the like.

In the area of physical development of individuals, it has been known for some time that swimming is one of the most beneficial forms of physical exercise. Persons, even those who may be physically or mentally handicapped, may benefit from being placed in a swimming pool, and they are encouraged to exercise their legs, arms and their body generally while in the water.

It is advantageous for persons generally to be able to exercise the upper part of the body as well as their legs. It is important to exercise the upper body as much as it is to exercise the legs of such handicapped individuals. Also, children who are handicapped and children who are not physically handicapped can benefit from using the present device to develop their arms as well as their legs and body generally.

2. Prior Art

Some of the physical exercise devices known from the prior art are:

U.S. Pat. No. 4,199,712 to Murphy that discloses a grid or rack of many hexagon-shaped segments positioned above a surface of water such as the water of a swimming pool. An individual can grasp alternate segments of the grid and progress in either direction relative to the water, and carry out an exercise program at the same time; and U.S. Pat. No. 3,929,330 to Cerasoli that discloses a parallel walking bar assembly that is used at home or in a hospital or clinic by physically handicapped persons. The apparatus comprises a pair of U-shaped base supports; a pair of walking bars having each end supported on one of the base supports. Adjustment means is provided to raise and lower the height of the walking bars to suit an individual using the device.

In contrast to these prior art devices, it is an object of the present invention to provide a physical exercise device that is particularly adaptable for use at a swimming pool; that can be easily installed; and that is adjustable for varying the degree of exercise desired by a person using the device.

SUMMARY OF THE INVENTION

A pool exercise device comprises: a pair of supports that may be placed close to the edge of a swimming pool; a pair of angularly-shaped end members are removably carried by the supports; bar means carried by and extending outward from each end member colinearly facing each other, are covered by a sleeve; and means for adjusting the relative position of said end members whereby the height of said bar means and said sleeve above the level of water in the pool is raised or lowered thereby increasing or decreasing the degree of exercise level as desired.

It is an object of the present invention to provide a simple, easily constructed and easily adjustable pool exercise device that can increase or decrease the level of difficulty of an exerise program for the upper body of a participant in the pool.

For a further understanding of the invention and for features and advantages thereof, reference may be had to the following description and to the drawing of a preferred embodiment of the invention.

DETAILED DESCRIPTION

Figure 1:
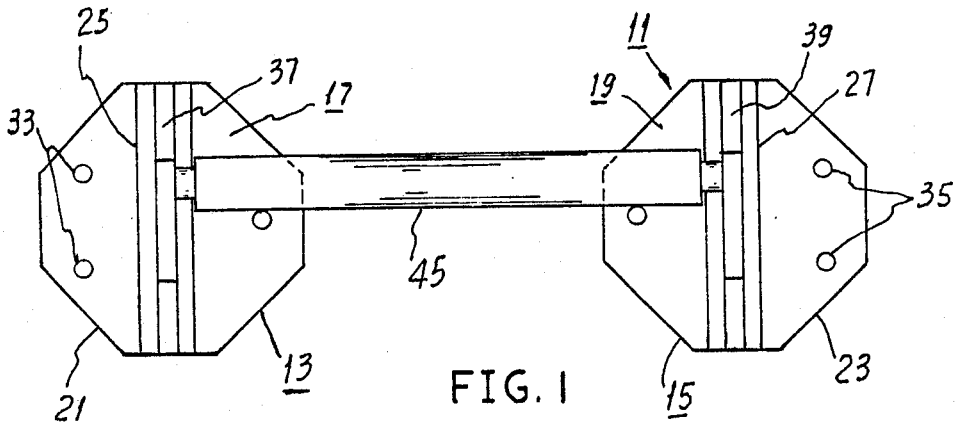
FIG. 1 is a schematic plan view of a pool exercise device in accordance with a preferred embodiment of the present invention.
Figure 2:
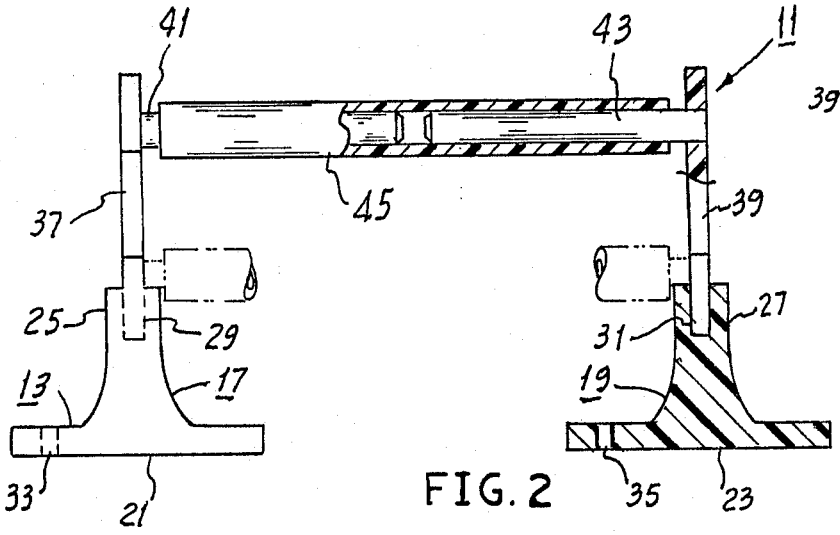
FIG. 2 is a schematic elevational view, partly in section, of the device of FIG. 1.
Figure 3:
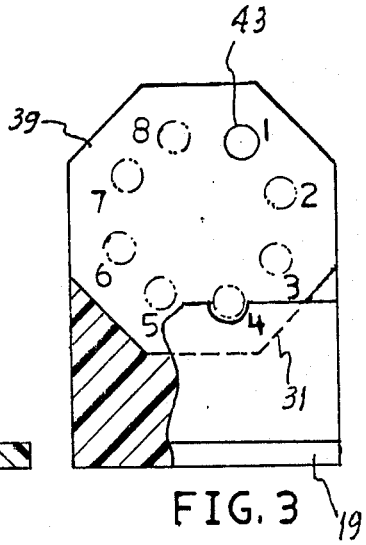
FIG. 3 is a view, partly in section, of the right-hand end of the device of FIG. 2.

Referring to FIGS. 1 and 2, a pool exercise device 11, in accordance with a preferred embodiment of the present invention, comprises a pair of supports 13,15. The supports 13,15 comprise bases 17,19 that have flat bottoms 21,23 and upright portions 25,27. The upright portions have slots 29,31 in the top portions, shaped like the lower part of an octagon, as shown in FIG. 3. The bases 17,19 also have holes 33,35 therethrough to receive fasteners, described hereinafter, that secure the supports 13,15 in selected locations near the edge of a pool, as described hereinafter.

The supports 13,15 accommodate octagonal, removable end members 37,39, disposed in the slots 29,31, and the members 37,39 have outwardly projecting cylindrical members or rods 41,43. Such cylindrical members or rods 41,43 are fixed in the end members 37,39 in any suitable manner. Surronding both of the facing cylindrical members or rods 41,43 is a sleeve 45.

In some instances, the end members may be hexagonal in shape to fit in slots shaped to receive them. In other instances, the end members may be angularly geometrically shaped and disposed in suitably shaped slots.

As shown in FIG. 3, the rods 41,43 and the sleeve 45 are positioned in a first location, designated 1. By lifting the end members 37,39 out of the slots 29,31 and rotating the end members clockwise, the end members 37,39 may be replaced in the slots 29,31 and then the rods 41,43 and the sleeve 45 will be positioned in a second location, designated 2. Continuing the removal, rotating and replacement of the end members, in a clockwise manner, the rods 41,43 and the sleeve 45 arrives at third and fourth locations, designated 3 and 4.

Each time the end members 37,39 are removed, rotated and replaced in the slots 29,31, the rods 41,43 and the sleeves are positioned closer to the level of the water in the pool. Then, a person in the water in the pool, who uses the device 11 of the present invention, finds it easier to grasp the sleeve and perform his exercise program.

In some instances, a person who uses the device of the present invention may remove the end members, rods and sleeve together and place end members 37 in slot 31 and end member 39 in slot 29. Then the rods 41,43 and sleeve 45 will be positionable in locations designated 5–8, by rotating the end members 37,39 as described previously.

Figure 4:
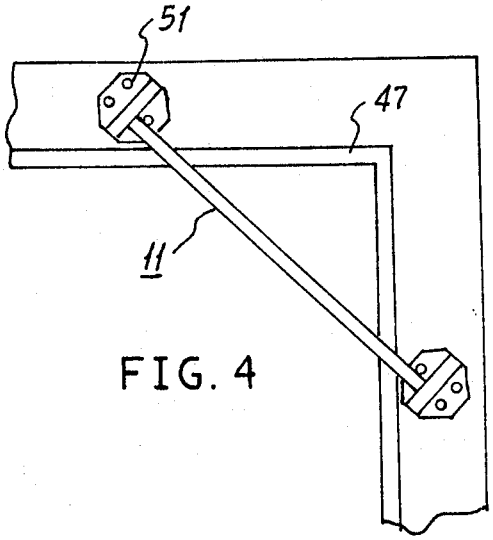
FIG. 4 is a schematic plan view of the device of FIGS. 1 and 2 showing it is an operative position at a corner of a rectangular pool.
Figure 5:
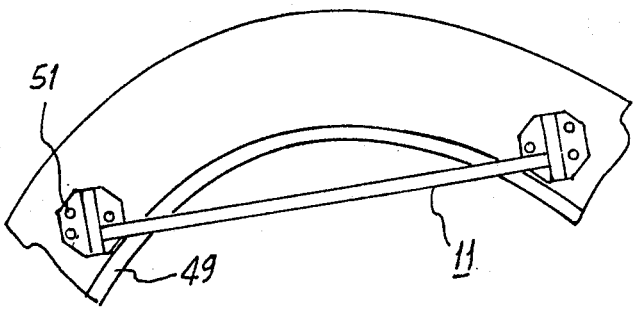
FIG. 5 is a plan view of the device of FIGS. 1 and 2 showing it in an operative position at a location at the end of an arcuate pool such as a round pool or a kidney-shaped pool.

Referring to FIGS. 4 and 5, the pool exercise apparatus 11 is conveniently located at a corner 47 of a rectangular pool, or it may be located at an arcuate portion 49 of a round or kidney-shaped pool. The pool exercise device 11 may be secured to the pool deck by means of fasteners 51 of any suitable type, or it may be secured temporarily in any suitable manner.

From the foregoing description of a preferred embodiment of the present invention, those skilled in the art will recognize many features and advantages thereof, among which the following are significant:

That the pool exercise device of the present invention is easy to install at a pool and is easy to adjust to suit a person in the pool using such device;

That the device is readily adjustably to suit the user's capabilities by rotating the end members and raising and lowering the rods and sleeve relative to the level of water in the pool;

That the device can be used by handicapped persons who are in the swimming pool; and That the device can be adjusted for use by children as well as adults.

Although the invention has been described herein with a certain degree of particularity, it is understood that other modifications may be made therein without departing from the scope of the present invention as defined by the following claims.

What is claimed is:

1. A pool exercise device for use by a person in water in a swimming pool comprising:

a pair of end supports, each support having a base and an upright portion;

a slot or groove in each upright portion that is shaped to removably receive an end member;

a rod secured to and projecting outwardly from each end member;

means for positioning said supports and the coacting end members adjacent an edge of said pool in such a way that said rods are disposed colinearly toward each other;

means for positioning each end member by removing said end member from its slot, selectively rotating said end member, and returning said end member to said slot so that said end member is slottingly secured therein thereby allowing the height of said rods to be adjusted up or down relative to the level of water in said pool, said means including a pair of multi-sided members and a pair of member-receiving slots;

a sleeve surrounding said colinear rods;

said sleeve being able to be grasped with one or more hands for exercising.

2. The device of claim 1 wherein each member is angular in shape.

3. The device of claim 1 wherein each end member is hexaongal in shape; and said slot or groove receives three sides of said end member so that said end members may be removed, selectively rotated, and returned to said slots or grooves whereby said members are slottingly secured therein.

4. The device of claim 1 wherein each end member is octagonal in shape and said slots receive three sides of said end member so that said end members may be removed, selectively rotated, and returned to said slots whereby said members are slottingly secured therein.

* * * * *